US009814311B2

(12) United States Patent
Mueller et al.

(10) Patent No.: US 9,814,311 B2
(45) Date of Patent: Nov. 14, 2017

(54) SAFETY CABINET WITH SEQUENTIAL DOOR-CLOSING SYSTEM

(71) Applicant: Justrite Manufacturing Company L.L.C., Des Plaines, IL (US)

(72) Inventors: Wesley J. Mueller, Arcola, IL (US); Dennis Michael Deedrich, Champaign, IL (US); Ronald Frank Auer, Mattoon, IL (US); Jeffrey Dale Bunting, Charleston, IL (US)

(73) Assignee: Justrite Manufacturing Company, LLC, Des Plaines, IL (US)

( * ) Notice: Subject to any disclaimer, the term of this patent is extended or adjusted under 35 U.S.C. 154(b) by 0 days.

(21) Appl. No.: 13/763,366

(22) Filed: Feb. 8, 2013

(65) Prior Publication Data

US 2013/0200767 A1 Aug. 8, 2013

Related U.S. Application Data

(60) Provisional application No. 61/596,462, filed on Feb. 8, 2012.

(51) Int. Cl.

| | |
|---|---|
| ***A47B 81/00*** | (2006.01) |
| ***E05F 5/12*** | (2006.01) |
| ***A47B 96/00*** | (2006.01) |
| *E05F 1/10* | (2006.01) |

(52) U.S. Cl.

CPC ..... *A47B 81/00* (2013.01); *A47B 96/00* (2013.01); *E05F 5/12* (2013.01); *E05F 1/1091* (2013.01); *E05Y 2201/218* (2013.01); *E05Y 2201/62* (2013.01); *E05Y 2201/626* (2013.01); *E05Y 2201/686* (2013.01); *E05Y 2600/322* (2013.01);

(Continued)

(58) Field of Classification Search

CPC ..... A47B 81/00; A47B 96/00; E05F 5/12
USPC ..... 312/215, 222, 324, 326, 329, 319.1, 312/319.2, 409; 49/366, 367
See application file for complete search history.

(56) References Cited

U.S. PATENT DOCUMENTS

| | | | |
|---|---|---|---|
| 177,207 | A | 5/1876 | Chandler |
| 188,512 | A | 3/1877 | Harlow |
| 943,471 | A | 12/1909 | Schoell |

(Continued)

FOREIGN PATENT DOCUMENTS

| | | |
|---|---|---|
| DE | 834348 | 3/1952 |
| DE | 9108804.6 | 11/1991 |

(Continued)

OTHER PUBLICATIONS

International Search Report prepared by the International Searching Authority in International Application No. PCT/US2013/025399, dated Apr. 15, 2013.

(Continued)

*Primary Examiner* — James O Hansen
(74) *Attorney, Agent, or Firm* — Leydig, Voit & Mayer, Ltd.

(57) ABSTRACT

A safety cabinet includes an enclosure having a double-walled construction and a pair of doors to selectively seal the enclosure. The safety cabinet can be used to store, for example, flammable liquids, flammable waste, corrosives, pesticides, or combustible waste. The safety cabinet incorporates a sequential door-closing system that sequentially closes the doors of the safety cabinet in a predetermined order.

16 Claims, 7 Drawing Sheets

(52) U.S. Cl.
CPC ..... *E05Y 2800/22* (2013.01); *E05Y 2900/21* (2013.01)

(56) References Cited

U.S. PATENT DOCUMENTS

| | | | | |
|---|---|---|---|---|
| 956,329 | A | | 4/1910 | Foster |
| 981,843 | A | | 1/1911 | Davis |
| 993,788 | A | | 5/1911 | Murphy |
| 1,019,934 | A | | 12/1911 | Walker |
| 1,176,407 | A | | 3/1916 | Shirey |
| 1,366,598 | A | | 1/1921 | Schroeder |
| 1,508,919 | A | | 9/1924 | Cain et al. |
| 1,909,697 | A | | 1/1932 | Roy |
| 1,973,854 | A | | 9/1934 | Hoffman et al. |
| 2,269,759 | A | | 1/1942 | Dollins |
| 2,592,289 | A | | 4/1952 | Joyner |
| 2,635,027 | A | | 4/1953 | Rasmussen |
| 2,735,706 | A | | 2/1956 | Pelcin |
| 2,913,296 | A | | 11/1959 | Martin |
| 3,010,585 | A | | 11/1961 | Slikkers |
| 3,023,068 | A | | 2/1962 | Haag |
| 3,044,631 | A | | 7/1962 | Greenman et al. |
| 3,168,365 | A | | 2/1965 | Evans |
| 3,269,788 | A | | 8/1966 | Kneer |
| 3,280,606 | A | | 10/1966 | Howard et al. |
| 3,376,669 | A | | 4/1968 | Johnston |
| 3,403,954 | A | | 10/1968 | Williams |
| 3,481,485 | A | | 12/1969 | Hess |
| 3,516,198 | A | | 6/1970 | Lyons |
| 3,623,785 | A | | 11/1971 | Williams |
| 3,819,216 | A | | 6/1974 | Richardson |
| 3,822,506 | A | | 7/1974 | Fishbach |
| 3,830,016 | A | | 8/1974 | Levine |
| 3,850,464 | A | | 11/1974 | Bisbing et al. |
| 3,895,461 | A | | 7/1975 | Maynard, Jr. et al. |
| 3,895,849 | A | | 7/1975 | Zehr |
| 4,073,384 | A | | 2/1978 | Celeste |
| 4,100,847 | A | | 7/1978 | Norton |
| 4,106,229 | A | | 8/1978 | Schmid |
| 4,126,330 | A | | 11/1978 | Poole |
| 4,146,994 | A | * | 4/1979 | Williams ..... 49/367 |
| 4,191,412 | A | | 3/1980 | LeKander |
| 4,229,956 | A | | 10/1980 | Thorburn |
| 4,231,597 | A | | 11/1980 | Pelcin |
| 4,262,448 | A | | 4/1981 | Flider |
| 4,265,051 | A | * | 5/1981 | Williams ..... 49/7 |
| 4,418,969 | A | | 12/1983 | Hettman |
| 4,456,316 | A | | 6/1984 | Lundgren |
| 4,517,765 | A | | 5/1985 | Mucha |
| 4,548,436 | A | | 10/1985 | Cole, Jr. |
| 4,583,324 | A | | 4/1986 | Storz et al. |
| 4,619,076 | A | | 10/1986 | Livingston |
| 4,671,014 | A | | 6/1987 | Lack |
| 4,679,835 | A | | 7/1987 | Weinerman et al. |
| 4,715,138 | A | | 12/1987 | Cherico |
| 4,775,057 | A | | 10/1988 | Zingeser |
| 4,782,675 | A | | 11/1988 | Thorburn |
| 4,892,338 | A | | 1/1990 | Weinerman et al. |
| 4,896,905 | A | | 1/1990 | Lehr et al. |
| 4,940,299 | A | | 7/1990 | Lazenby |
| 4,949,505 | A | | 8/1990 | Cohrs |
| 4,967,512 | A | | 11/1990 | Schroder et al. |
| 4,989,907 | A | | 2/1991 | Edmonds et al. |
| 5,046,446 | A | | 9/1991 | Sumrall et al. |
| 5,050,327 | A | | 9/1991 | Woltman |
| 5,061,022 | A | | 10/1991 | Meriwether |
| 5,072,977 | A | | 12/1991 | Millman et al. |
| 5,077,940 | A | | 1/1992 | LaRose, Jr. |
| 5,078,437 | A | | 1/1992 | Borgmeyer et al. |
| 5,121,952 | A | | 6/1992 | Jason |
| 5,127,340 | A | | 7/1992 | Maro et al. |
| 5,158,329 | A | | 10/1992 | Schlack |
| 5,172,944 | A | | 12/1992 | Munich et al. |
| 5,176,437 | A | | 1/1993 | Remington |
| 5,192,123 | A | | 3/1993 | Wallin |
| 5,254,798 | A | | 10/1993 | Zoback |
| 5,275,029 | A | | 1/1994 | Myers |
| D347,155 | S | | 5/1994 | Schlack et al. |
| 5,307,653 | A | | 5/1994 | Davis |
| 5,340,172 | A | | 8/1994 | Sweet |
| 5,356,206 | A | | 10/1994 | Van Valkenburgh |
| 5,377,622 | A | | 1/1995 | Lauttenbach et al. |
| D357,396 | S | | 4/1995 | Ziemer et al. |
| 5,427,420 | A | | 6/1995 | Moore |
| 5,452,929 | A | | 9/1995 | Anderson |
| D364,329 | S | | 11/1995 | Ziemer et al. |
| 5,464,259 | A | | 11/1995 | Cohrs et al. |
| 5,473,845 | A | | 12/1995 | Livingston et al. |
| 5,493,881 | A | | 2/1996 | Harvey |
| D370,620 | S | | 6/1996 | Ziemer |
| 5,582,472 | A | | 12/1996 | Lyons et al. |
| 5,603,535 | A | | 2/1997 | Antonucci et al. |
| 5,669,640 | A | | 9/1997 | Ryan |
| 5,704,476 | A | | 1/1998 | Abbott |
| 5,722,202 | A | | 3/1998 | Cooper |
| 5,792,379 | A | | 6/1998 | Salmon |
| 5,791,174 | A | | 8/1998 | Fitzgerald et al. |
| 5,794,826 | A | | 8/1998 | Cronce et al. |
| 5,795,043 | A | | 8/1998 | Johnson et al. |
| 5,813,739 | A | | 9/1998 | White |
| D399,121 | S | | 10/1998 | Alyanakian et al. |
| 5,820,174 | A | | 10/1998 | Parikh et al. |
| 5,878,608 | A | | 3/1999 | Alyanakian |
| 5,934,716 | A | | 8/1999 | Koveal et al. |
| 5,941,104 | A | | 8/1999 | Sadler |
| 5,944,399 | A | * | 8/1999 | Gillispie ..... 312/324 |
| 5,974,842 | A | | 11/1999 | Schlack et al. |
| 5,975,318 | A | | 11/1999 | Jay |
| 5,983,682 | A | | 11/1999 | Parikh |
| 5,992,098 | A | | 11/1999 | Flider et al. |
| D419,053 | S | | 1/2000 | Schlack |
| 6,023,953 | A | | 2/2000 | Vickers et al. |
| 6,050,618 | A | | 4/2000 | Tieu |
| D425,395 | S | | 5/2000 | Ji |
| 6,058,748 | A | | 5/2000 | Beals, Jr. et al. |
| 6,152,497 | A | | 11/2000 | Vickers et al. |
| 6,250,014 | B1 | | 6/2001 | Rusiana |
| 6,250,015 | B1 | * | 6/2001 | Gillispie ..... 49/367 |
| 6,263,712 | B1 | | 7/2001 | Ramsauer |
| 6,293,130 | B1 | | 9/2001 | Ramsauer |
| 6,427,501 | B2 | | 8/2002 | Ramsauer |
| 6,470,610 | B1 | | 10/2002 | Northey |
| 6,481,252 | B2 | | 11/2002 | Calle et al. |
| 6,513,888 | B1 | | 2/2003 | Lucht |
| 6,543,821 | B1 | | 4/2003 | Weinerman et al. |
| 6,546,765 | B1 | | 4/2003 | Linares |
| 6,547,290 | B1 | | 4/2003 | Zenner et al. |
| 6,553,798 | B1 | | 4/2003 | Larsen et al. |
| 6,584,916 | B1 | | 7/2003 | Felton et al. |
| 6,623,052 | B2 | | 9/2003 | Hansen |
| 6,652,954 | B2 | | 11/2003 | Neilsen et al. |
| 6,657,123 | B2 | | 12/2003 | Moore |
| 6,729,701 | B2 | | 5/2004 | Carter et al. |
| 6,755,053 | B1 | | 6/2004 | Dias |
| 6,854,304 | B2 | | 2/2005 | Linares |
| 6,871,747 | B2 | | 3/2005 | Bustos |
| 7,001,001 | B1 | | 2/2006 | Spencer |
| 7,006,876 | B2 | | 2/2006 | Ross |
| 7,029,078 | B1 | | 4/2006 | Fromme et al. |
| 7,275,770 | B2 | | 10/2007 | Guebre-Tsadik et al. |
| 8,172,344 | B2 | | 5/2012 | Eyer et al. |
| 2003/0001465 | A1 | | 1/2003 | Carter et al. |
| 2004/0066122 | A1 | | 4/2004 | Holmes |
| 2005/0110373 | A1 | | 5/2005 | Assmann |
| 2005/0221042 | A1 | | 10/2005 | Chirhart et al. |
| 2005/0224428 | A1 | | 10/2005 | Weber |
| 2005/0262897 | A1 | | 12/2005 | Parsons |
| 2006/0059934 | A1 | | 3/2006 | Howington et al. |
| 2007/0205703 | A1 | | 9/2007 | McLuckie et al. |
| 2008/0073914 | A1 | | 3/2008 | Eller et al. |
| 2008/0106174 | A1 | | 5/2008 | Marcus et al. |
| 2008/0211363 | A1 | | 9/2008 | Carter et al. |
| 2008/0223091 | A1 | | 9/2008 | Kroening et al. |
| 2009/0085447 | A1 | | 4/2009 | McLuckie et al. |

(56) References Cited

U.S. PATENT DOCUMENTS

| | | | |
|---|---|---|---|
| 2009/0091220 | A1 | 4/2009 | Eyer et al. |
| 2010/0213802 | A1 | 8/2010 | Backhaus |
| 2012/0242208 | A1 | 9/2012 | Eyer et al. |
| 2013/0200767 | A1 | 8/2013 | Mueller et al. |

FOREIGN PATENT DOCUMENTS

| | | | |
|---|---|---|---|
| DE | 29604679 | U | 5/1996 |
| DE | 29711737 | | 12/1998 |
| DE | 29711740 | | 12/1998 |
| DE | 20319136 | | 6/2005 |
| EP | 0156044 | A3 | 10/1985 |
| EP | 0893558 | | 1/1999 |
| EP | 1531218 | B1 | 2/2009 |
| FR | 2113501 | | 6/1972 |
| GB | 437577 | | 10/1935 |
| GB | 2028912 | | 3/1980 |
| WO | WO 2010/130440 | A1 | 11/2010 |

OTHER PUBLICATIONS

Written Opinion prepared by the International Searching Authority in International Application No. PCT/US2013/025399, dated Apr. 15, 2013.

European Patent Office, Extended European Search Report in Patent Application No. 13746011.9, dated Sep. 1, 2015, 7 pages.

Understanding Safety Cabinets, http://www.justritemfg.com/pdf/UnderstandingSafetyCabinet.pdf, 5 pages (2012).

Safe-T-Store, www.prioritysupplies.com.au/brochure, 12 pages (2012).

Dangerous Goods Cabinets, www.dmdshelving.com.au/index, 2 pages (2012).

Flammable Liquids Storage Cabinets, www.hazchem.net.au, 3 pages (2006).

S.E.P.M.A.R. Safety Storage Cabinets, http://www.sepinar-firex.com.au/wp-content, 2 pages (2012).

* cited by examiner

SAFETY CABINET WITH SEQUENTIAL DOOR-CLOSING SYSTEM

CROSS-REFERENCE TO RELATED APPLICATIONS

This patent application claims the benefit of priority to U.S. Provisional Patent Application No. 61/596,462, filed on Feb. 8, 2012, and entitled "Safety Cabinet With Sequential Door-Closing System," which is incorporated in its entirety herein by this reference.

TECHNOLOGICAL FIELD

The present disclosure pertains generally to a safety cabinet for flammable, combustible, or other hazardous materials, and more particularly to a safety cabinet with a sequential door-closing system.

BACKGROUND

A safety cabinet can be used for the onsite storage of flammable material at a plant, for example. The safety cabinet can be provided to insulate flammable material stored within it from the direct effects of an external fire to prevent the contents of the safety cabinet from adding to the deleterious effect of the original fire.

Previous safety cabinets have included a mechanism for automatically closing their doors to increase the cabinets' functionality as safety devices. U.S. Pat. No. 5,992,098 to Flider et al. is entitled, "Safety Cabinet Latching System." The Flider safety cabinet includes a closure mechanism adapted to automatically close and latch the doors in the event of fire. The closing mechanism is fully automatic and includes a timing slide bracket and associated components to time the closing of the doors so that the door having a sealing lip is in the closed position before the other door. The present disclosure is directed to providing a safety cabinet with a sequential door-closing system.

SUMMARY OF THE DISCLOSURE

In one embodiment, a safety cabinet includes an enclosure, first and second doors, and a sequential-door closing system. The enclosure defines an opening. The first door and the second door are rotatably mounted to the enclosure and moveable over a range of travel between an open position and a closed position. The first and second doors are adapted to cover the opening of the enclosure when in the closed position. The sequential door-closing system is adapted to sequentially close the first and second doors such that when the first and second doors move in respective first and second door closing paths from the open position to the closed position, the first door is in the closed position before the second door.

The sequential door-closing system includes a stop member, a connecting assembly, and a trigger member. The stop member is rotatably mounted to the enclosure and moveable over a range of travel between a stop position, in which at least a portion of the stop member is disposed in the second door closing path of the second door, and a retracted position, in which the stop member is displaced from the second door closing path. The stop member is biased to the stop position. The connecting assembly is in interconnecting relationship with the stop member and the trigger member. The connecting assembly is adapted to interact with the trigger member to selectively retain the stop member in the stop position. The trigger member is rotatably mounted to the enclosure and moveable over a range of travel between a lock position, in which the trigger member and the connecting assembly are in interlocking relationship to prevent rotational movement of the stop member from the stop position and in which at least a portion of the trigger member is disposed in the first door closing path of the first door, and a retracted position, in which the trigger member is displaced from the first door closing path. The trigger member is biased to the lock position.

As the second door moves over the second door closing path from the open position to the closed position, the stop member is adapted to selectively stop the second door at a trailing door position along the second door closing path and to prevent the second door from moving to the closed position. As the first door moves over the first door closing path from the open position to the closed position, the first door contacts the trigger member such that continued movement of the first door to the closed position causes the trigger member to rotate in a release direction away from the locked position to the retracted position to thereby disengage from the connecting assembly, thereby allowing the stop member to rotate away from the stop position to the retracted position the second door to move to the closed position after the first door is in the closed position.

In another embodiment, a sequential door-closing system is configured to sequentially close first and second doors rotatably mounted to an enclosure. The first and second doors are each movable over a range of travel between an open position and a closed position. The sequential door-closing system includes a stop member, a connecting assembly, and a trigger member.

The stop member is adapted to be rotatably mounted to the enclosure and moveable over a range of travel between a stop position and a retracted position. The stop member is biased to the stop position.

The connecting assembly is in interconnecting relationship with the stop member and the trigger member. The connecting assembly is adapted to interact with the trigger member to selectively retain the stop member in the stop position.

The trigger member is adapted to be rotatably mounted to the enclosure and moveable over a range of travel between a lock position, in which the trigger member and the connecting assembly are in interlocking relationship to prevent rotational movement of the stop member from the stop position, and a retracted position. The trigger member is biased to the lock position. Moving the trigger member from the lock position in a release direction toward the retracted position disengages the trigger member from the connecting assembly such that the stop member is rotatable from the stop position to the retracted position.

Further and alternative aspects and features of the disclosed principles will be appreciated from the following detailed description and the accompanying drawings. As will be appreciated, the principles related to sequential door-closing systems and safety cabinets disclosed herein are capable of being carried out in other and different embodiments, and capable of being modified in various respects. Accordingly, it is to be understood that the foregoing general description and the following detailed description is exemplary and explanatory only and does not restrict the scope of the disclosed principles.

DETAILED DESCRIPTION OF EMBODIMENTS

Figure 1:
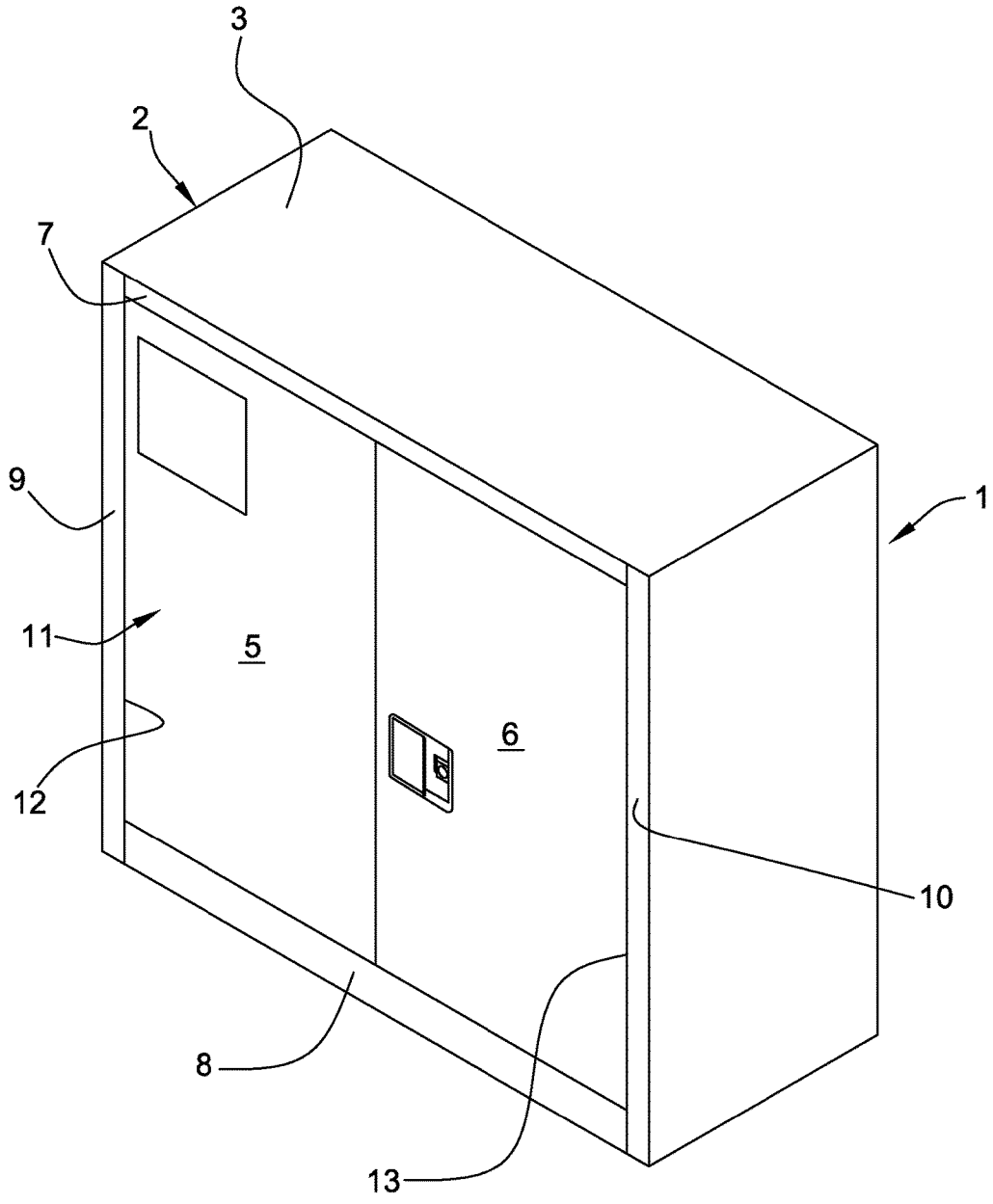
FIG. 1 is a perspective view of an embodiment of a safety cabinet constructed in accordance with principles of the present disclosure, illustrating a pair of doors in a closed position.

To help ensure that doors of a safety cabinet close in a way that provides a sealing relationship therebetween, embodiments of the present disclosure provide a sequential door-closing system adapted to sequentially close the doors of a safety cabinet. In some embodiments, the sequential door-closing system of the safety cabinet selectively closes a door having an inner seal flange prior to closing the other door. In some embodiments, the sequential door-closing system can be located between an inner top wall and an outer top wall of the safety cabinet enclosure. In some embodiments, the sequential door-closing system includes a stop and a trigger member that are positioned so as to come into contact with the first and second doors of the safety cabinet, respectively, when the doors are closing and a connecting assembly which interconnects the stop and the trigger member.

In embodiments, the stop member is pivotally mounted to a base plate secured to the enclosure of the safety cabinet by a pivot pin. A rotating wheel is mounted to a distal end of the stop member, and the opposing, connecting end of the stop member is pivotally connected to one end of a connecting member of the connecting assembly. A stop spring is attached at one end to a spring anchor, which is secured to the mounting plate supporting the stop member, and at the other end to both the connecting end of the stop member and the first end of the connecting member. The stop spring is adapted to bias the stop member to a stop position wherein the stop member prevents a door from moving fully to the closed position.

In embodiments, the trigger member is pivotally mounted to a base plate secured to the enclosure of the safety cabinet by a pivot pin. The trigger member includes a rotating wheel disposed at a distal end thereof. The opposing, locking end of the trigger member is adapted to selectively engage a cam of the connecting assembly so as to prevent rotation of the cam about a pivot pin in a closing direction. A notched end of the cam is retentively engageable with the locking end of the trigger member. The other end of the cam is connected to a second end of the connecting member. A trigger spring is attached at one end to the locking end of the trigger member and at the other end to both the connecting end of the cam and the second end of the connecting member. The trigger spring is adapted to bias the trigger member to a lock position wherein the trigger member and the cam are in interlocking relationship with each other. The interlocking relationship between the trigger member and the cam prevents rotational movement of the cam, which in turn prevents rotational movement of the stop through the rigid connection provided between the cam and the stop by the connecting member.

As a trailing door moves in a closing direction, the stop of the sequential door-closing system is adapted to selectively prevent the trailing door from continuing to close. Specifically, when the trailing door contacts the stop, the movement of the trailing door toward the closed position is temporarily stopped. The locked relationship between the trigger member and the cam and the interconnection of the cam with the stop through the connecting member prevent the stop from moving in a closing direction when the trailing door engages the stop.

As a leading door moves in a closing direction, the leading door comes into contact with the distal end of the trigger member. Continued movement of the leading door in the closing direction rotates the trigger member about a pivot pin in a release direction, thereby causing the trigger member to move away from its locked position with the cam, thereby disengaging the cam. The leading door moves to the fully-closed position.

After the trigger member is disengaged from the cam, the cam is allowed to rotate about its pivot pin in the closing direction, and, thus, the stop can also rotate. Rotation of the stop in the closing direction out of the closing path of the trailing door, allows the trailing door to close. In this manner, the leading door is closed prior to the trailing door, which allows the effective sealing of the safety cabinet, thereby limiting the exposure of the flammable materials housed therein.

In some embodiments, a safety cabinet can include a first and a second door. Each door is movable over a range of travel between a closed position and a range of open positions. The first door can include an inner seal flange. In some embodiments, the second door can include an outer seal flange. Each seal flange can be adapted to extend from the door to which it is attached a predetermined distance toward the other door such that the air gap defined between the first and second doors when the doors are in the closed position is occluded by the flange. The sequential door-closing system can be adapted to control the sequence of the closing of the doors such that the door having the inner seal flange (in this case, the first door) is disposed in the closed position with the other door being in one of a range of open positions. The sequential door-closing system is adapted to prevent the other door from moving to the closed position until the first door is in the closed position. A pair of actuators can be respectively associated with the first and second doors to provide an automatic closing feature.

Figure 2:
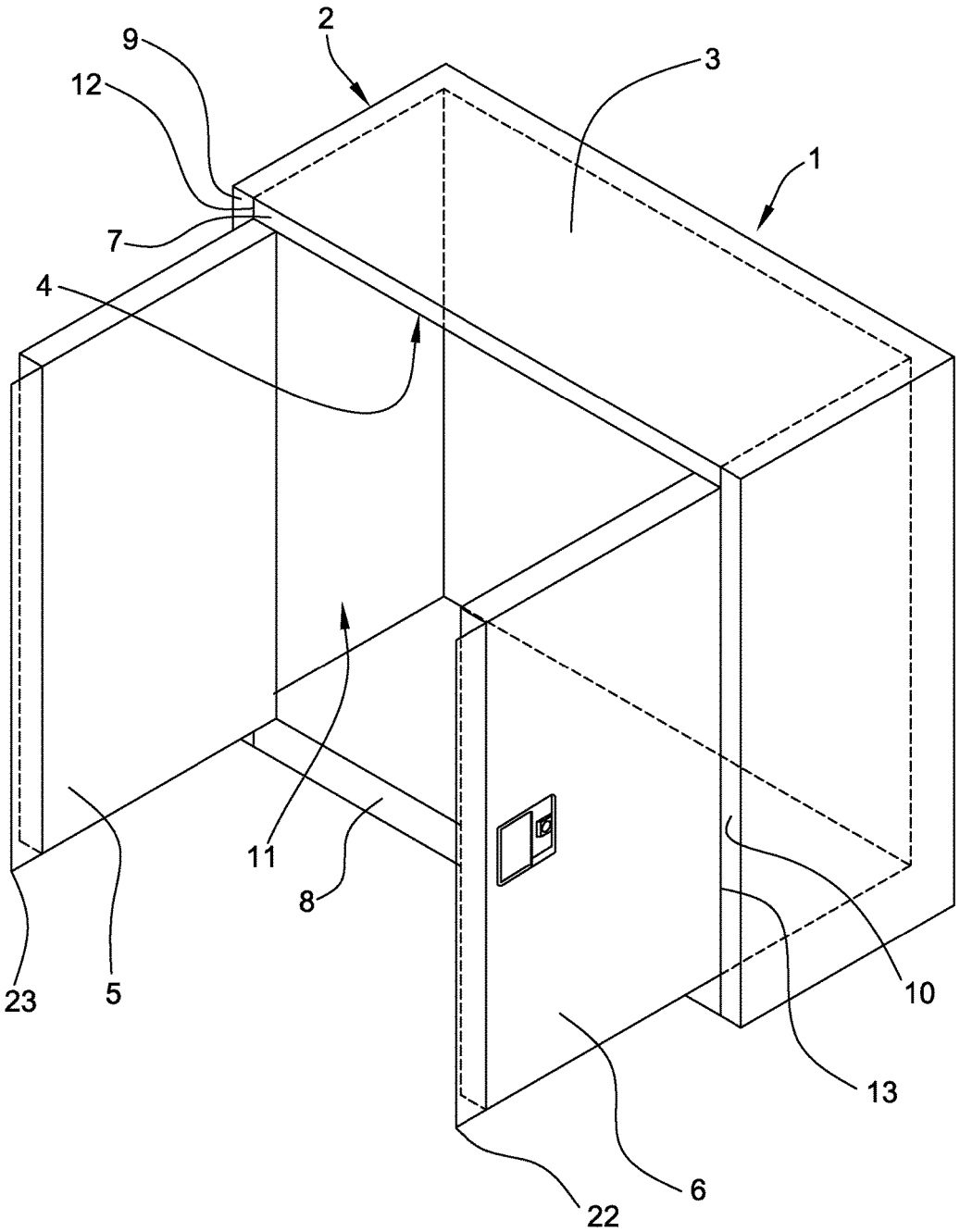
FIG. 2 is a perspective view of the safety cabinet of FIG. 1, illustrating the door in an open position.

Turning now to the drawings, referring to FIGS. 1 and 2, a safety cabinet 1 of double-walled construction is shown. The safety cabinet 1 can be used to store flammable, combustible, or other hazardous materials. The safety cabinet 1 includes an enclosure 2 having an outer shell 3 and an inner shell 4, a left door 5, and a right door 6. The enclosure 2 includes the inner shell 4 to provide a double-walled construction, wherein each outer wall of outer shell 3 has a corresponding inner wall of the inner shell 4, with the corresponding inner and the outer walls separated by a predetermined distance to define an insulative air space. The left and right doors 5, 6 each have a double-walled construction similar to the enclosure 2. The enclosure 2 also includes a top jamb 7, a bottom jamb 8, a left jamb 9, and a right jamb 10. The jambs 7, 8, 9, 10 bound and define an enclosure opening 11.

As best seen in FIGS. 1 and 2, the left and right doors 5, 6 selectively cover the enclosure opening 11 of the enclosure 2 and are respectively moveable over a range of travel between a closed position and a range of open positions. The left and right doors 5, 6 are adapted to cover the opening 11 of the enclosure 2 when in the closed position. Referring to FIG. 1, the left door 5 and the right door 6 are preferably rotatably mounted to the enclosure 2 by first and second hinges 12, 13, respectively. The first hinge 12 is mounted to the left jamb 9 of the enclosure 2 and to the left door 5. The second hinge 13 is mounted to the right jamb 10 of the enclosure 2 and to the right door 6. The first and second hinges 12, 13 both extend substantially the full height of the left and right doors 5, 6, respectively.

FIGS. 3-6 show the left and right doors 5, 6 at various positions over their range of travel, including at an opened position, at an intermediate position, and at a closed position. In some embodiments, the safety cabinet can include means for automatically closing the doors. In the illustrated embodiment, first and second air cylinders 14, 15 are attached to the left and right doors 5, 6, respectively, and to the enclosure 2. The air cylinders 14, 15 are adapted to bias the left and right doors 5, 6 to their closed positions.

Figure 3:
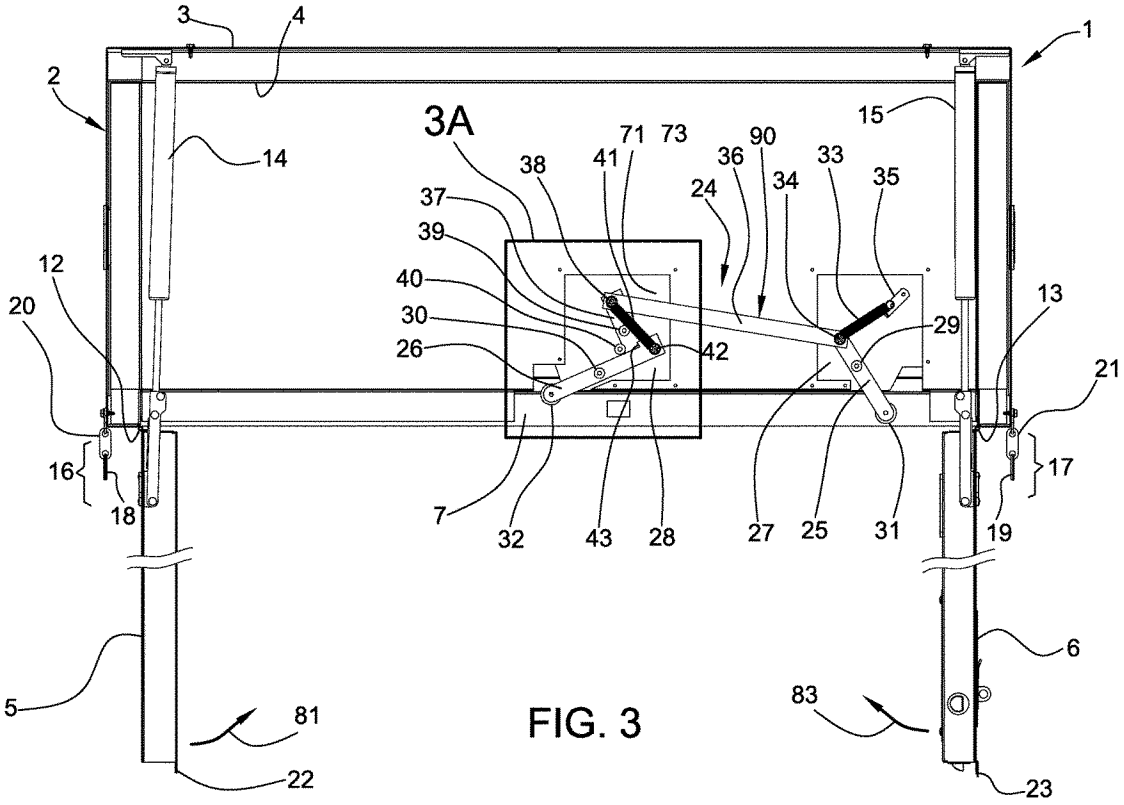
FIG. 3 is a top plan view of the safety cabinet of FIG. 1 with a top panel thereof removed for illustrative purposes, illustrating an embodiment of a sequential door-closing system constructed in accordance with principles of the present disclosure and showing the doors in an open position.

While loading and unloading the safety cabinet 1, however, it may be desirable that the doors 5, 6 remain in an open position. In some embodiments, the safety cabinet can include means for selectively retaining the doors in an open position. In the illustrative embodiment, first and second door retention mechanisms 16, 17 are respectively provided to selectively retain the doors 5, 6 in the open position, as shown in FIG. 3.

In some embodiments, each door retention mechanism 16, 17 includes a retaining element 18, 19 which is adapted to be selectively connected to a fusible link 20, 21 to hold the doors 5, 6 in an open position. The door retention mechanisms 16, 17 are mounted to the enclosure 2 and to the left and right door 5, 6, respectively. In some embodiments, the first and second retaining elements 18, 19 each has a detent feature that acts to selectively retain the respective door 5, 6, in the open position.

The fusible links 20, 21 can be constructed to fuse, i.e., melt, when the ambient temperature reaches a certain level. When the doors 5, 6 are held open by the door retention mechanisms 16, 17, respectively, and the ambient temperature exceeds a threshold level, the links 20, 21 fuse, thereby releasing the doors 5, 6 and allowing the cylinders 14, 15 to move the doors 5, 6, respectively toward the closed position. In some embodiments, the fusible links 20, 21 are configured to fuse when the ambient temperature exceeds about 165° F.

The left door 5 includes an inner sealing flange 22, and the right door 6 includes an outer sealing flange 23. The sealing flanges 22, 23 extend along substantially the entire height of the door 5, 6 to which it is attached. Each sealing flange 22, 23 is adapted to extend from the respective door 5, 6 to which it is attached to a position in which it is in overlapping relationship with the other door 6, 5, respectively, when the doors 5, 6 are in the closed position.

To create a more effective seal, the inner and outer sealing flanges 22, 23 of the left and right doors 5,6 are arranged such that the inner sealing flange 22 of the left door 5 is disposed in inward relationship to the right door 6, and the outer sealing flange 23 of the right door 6 is disposed in outer relationship to the left door 5. If not closed in this relationship, the sealing flanges 22, 23 will be in interfering relationship with each other such that the right door 6 can be moved to the closed position, but the left door 5 will be prevented from doing so.

When the doors 5, 6 are closed in a sequence wherein the left door 5 is in the closed position prior to the right door 6 being in a closed position, and, thereafter, the right door 6 moves to the closed position, the sealing flanges 22, 23 cooperate to form an effective seal between the doors 5, 6 to further protect the contents stored within the safety cabinet from the outside environment. When sealed in this manner, flame and high temperature ambient air can be further inhibited from entering the enclosure 2 of safety cabinet 1.

To ensure that the doors 5, 6 are closed in a way that maintains the structural integrity of the safety cabinet 1 and allows both doors 5, 6 to be moved to the fully-closed position, the safety cabinet 1 can include a sequential door-closing system 24. The sequential door-closing system 24 is adapted to sequentially close the doors 5, 6 such that the left door 5 is in the closed position prior to the right door 6 moving to the closed position.

The sequential door-closing system 24 can be adapted to sequentially close the left and right doors 5, 6 such that when the left and right doors 5, 6 move in respective left and right door closing paths from the open position to the closed position, the left door 5 is in the closed position before the right door 6. In other embodiments, the sequential door-closing mechanism 24 can be adapted to prevent the left door 5 from moving to the closed position until the right door 6 is first in the closed position.

In the embodiment shown, the sequential door-closing system 24 is disposed between the inner top wall and outer top wall of the safety cabinet 1. The sequential door-closing system 24 can be positioned in other locations of the safety cabinet 1 in other embodiments. For example, the sequential door-closing system 24 can be disposed between the inner bottom wall and outer bottom wall of safety cabinet 1.

The safety cabinet 1 can also include a latch system and a lock system. After the doors 5, 6 are sequentially closed by the sequential door-closing system 24, the latch and lock systems of the safety cabinet 1 retain the doors 5, 6 in the closed position and help prevent unauthorized access to the interior of the safety cabinet. In embodiments, the latch system can comprise a three-point latch system having various configurations. In embodiments, the latch system can be a slam latch type which permits the left and right doors 5, 6 to be moved to the closed position without the need top operate a latch actuator. The latch system and the lock system can be similar in construction and functionality to those of the safety cabinets shown and described in U.S. Pat. No. 6,729,701 and/or U.S. Patent Application Publication No. US2008/0106174, which are incorporated in their entireties herein by this reference.

FIG. 3 shows the safety cabinet 1 with the doors 5, 6 open. The sequential door-closing system 24 includes a stop 25, a trigger 26 and a connecting assembly 90. The stop 25 and the trigger 26 are respectively rotatably mounted to first and second base plates 27, 28 via pivot pins 29, 30.

The stop 25 is rotatably mounted to the enclosure 2 and moveable over a range of travel between a stop position (FIG. 3), in which at least a portion of the stop 25 is disposed in a right door closing path of the right door 6, and a retracted position (FIG. 6), in which the stop 25 is displaced from the right door closing path. The stop 25 is biased to the stop position.

The trigger 26 is rotatably mounted to the enclosure 2 and moveable over a range of travel between a lock position (FIG. 3), in which the trigger 26 and the connecting assembly 90 are in interlocking relationship to prevent rotational movement of the stop 25 from the stop position and in which at least a portion of the trigger 26 is disposed in a left door closing path of the left door 5, and a retracted position (FIG. 5), in which the trigger 26 is displaced from the left door closing path. The trigger 26 is biased to the lock position.

First and second rotating wheels 31, 32 are affixed to distal ends of the stop 25 and the trigger 26, respectively. The stop 25 and the trigger 26 are positioned near the opening of the enclosure 2 so that the distal ends of the stop 25 and the trigger 26 project outwardly from the base plates 27, 28 so that they are disposed in the area in which the doors 5, 6 reside when in the closed position. With such an arrangement, the rotating wheels 31, 32 come into contact with the doors 5, 6, respectively, as the doors 5, 6 move over the let and right door closing paths, respectively, from an open position and approach the closed position. The distal end of the stop 25 is in outward relationship to the distal end of the trigger 26 such that the rotating wheel 21 of the stop 25 is closer to the right door 6 along its line of travel when moving to the closed position than the rotating wheel 32 of the trigger 26 is to the left door 5.

The connecting assembly 90 is in interconnecting relationship with the stop 25 and the trigger 26. The connecting assembly 90 is adapted to interact with the trigger 26 to selectively retain the stop 25 in the stop position. The connecting assembly 90 can include a connecting member or crosslink 36 and a cam 37. The crosslink 36 and the cam 37 are pivotally connected together.

The sequential door-closing system 24 also includes a stop spring 33, which is connected to the stop 25 and an end of a connecting member 36 with a stop-crosslink pivotal connector 34. The other end of the stop spring 33 is affixed to the first base plate 27 via a first spring anchor 35. The other end of the connecting member or crosslink 36 is similarly pivotally connected to a cam 37 at a cam-crosslink pivotal connector 38. The cam 37 is rotatably mounted to the second base plate 28 via a cam pivot pin 39. The crosslink 36 links the stop 25 and the cam 37. Rotation of the cam 37 about the cam pivot pin 39 in an extending direction 71 is limited by a cam stop pin 40. A trigger spring 41 links the crosslink 36, the cam 37, and the trigger 26. The trigger spring 41 extends between the cam crosslink connector 38 and a locking end 42 of the trigger 26.

Figure 3A:
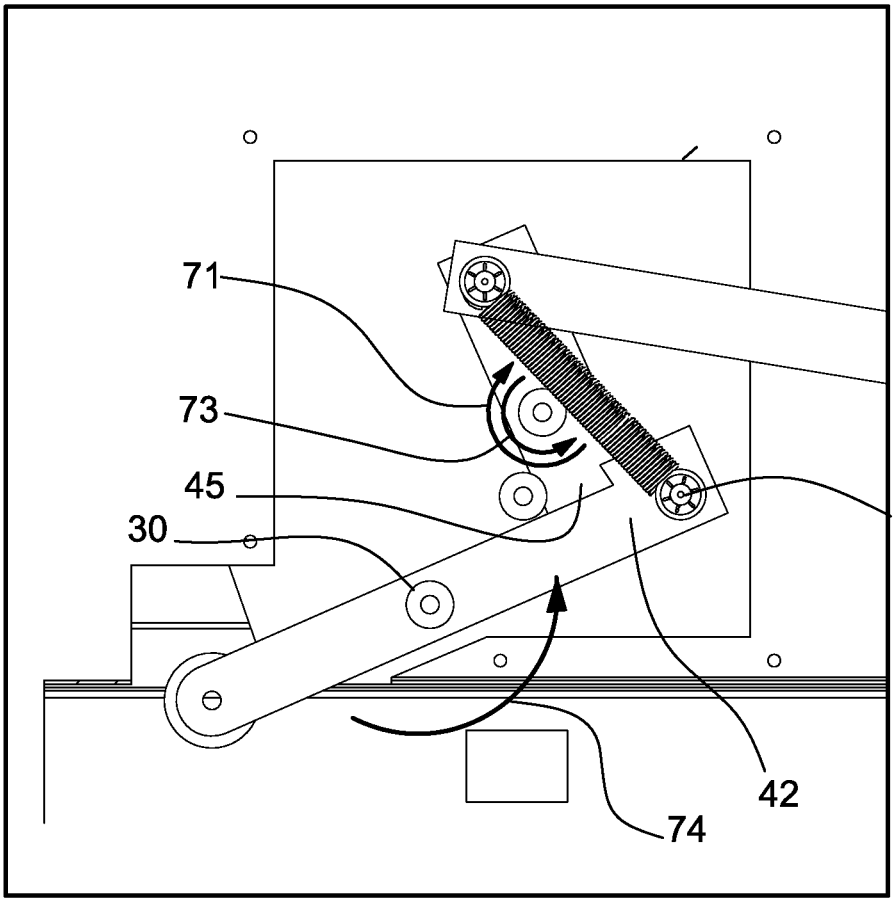
FIG. 3A is an enlarged, detail view taken from FIG. 3 from the area indicated.

As shown in FIGS. 3 and 3A, when the doors 5, 6 are open, the stop spring 33 biases the stop 25 so that the distal end 31 of the stop 25 protrudes from the enclosure 2 of the safety cabinet 1 farther than the distal end 32 of the trigger 26, and the trigger spring 31 biases the locking end 42 of the trigger 26 to rotate about the trigger pivot pin 30 in a locking direction 74 into locking relationship with the notched end 45 of the cam 37 such that the cam 37 is prevented from rotating in the closing direction 73. The crosslink 36 interconnects the cam 37 and the stop 25 such that the stop 25 is prevented from rotating. In this configuration, as the doors 5, 6 close, the right door 6 comes into contact with the distal end 31 of the stop 25 before the left door 5 comes into contact with the distal end 32 of the trigger 26. When the doors 5, 6 are open, the stop spring 33 biases the crosslink 36 such that the cam 37 is positioned against the cam stop pin 40. With the cam 37 abutting the cam stop pin 40, the trigger spring 41 urges the cam 37 and the trigger 26 into interlocking relationship at a locking interface 43, placing the sequential door-closing system 24 in a ready position.

The air cylinders 14, 15 can move the left and right doors 5, 6, respectively from the open position shown to the closed position. The air cylinders 14, 15 can act upon the left and right doors 5, 6, respectively such that the doors rotate about the respective hinges 12, 13, respectively, in a closing direction 81, 83.

Figure 4:
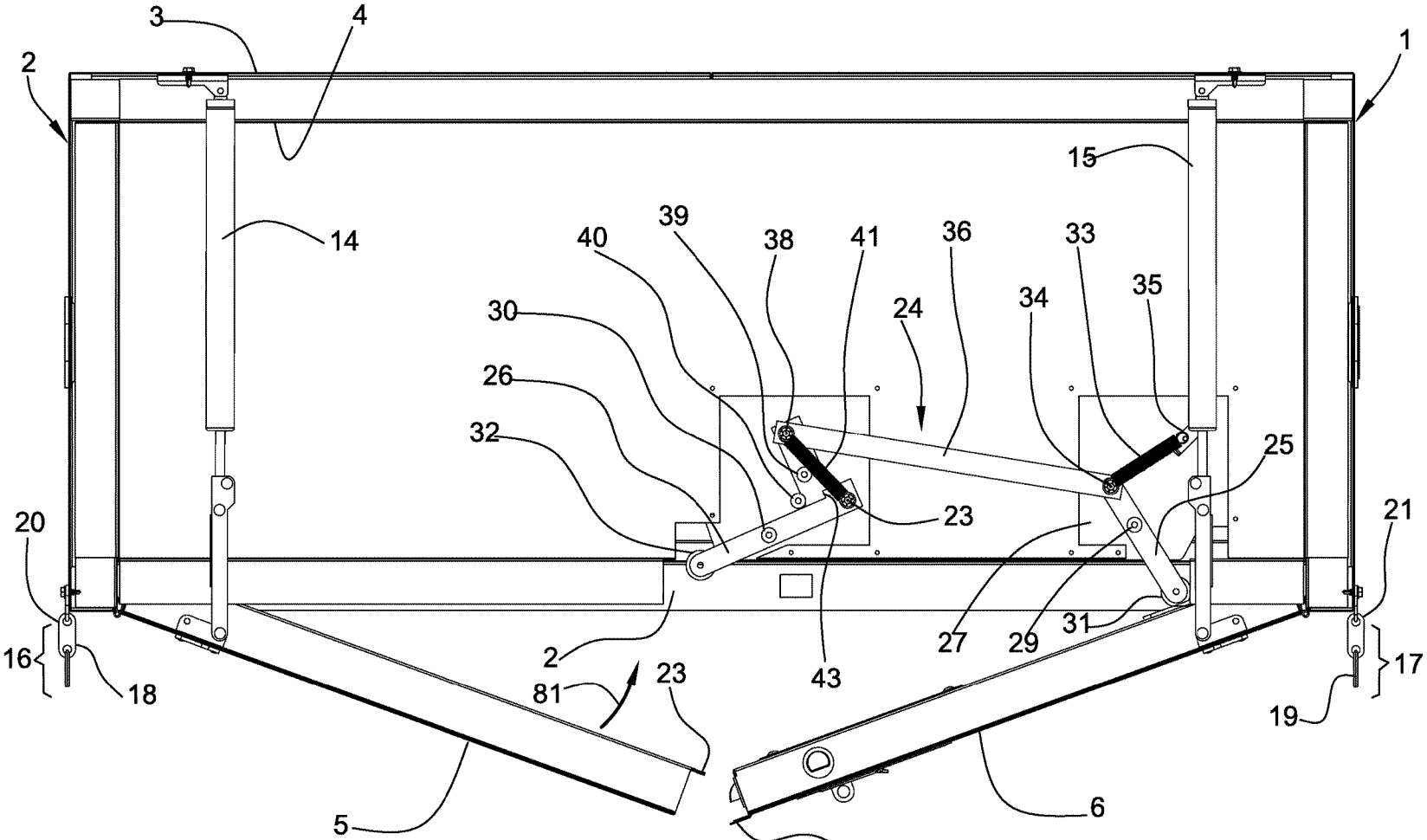
FIG. 4 is a top plan view of the safety cabinet as in FIG. 3, illustrating the doors in an open position in which the right door is engaged with a stop of the sequential door-closing system.

FIG. 4 shows the left door 5 in one of a range of open positions, and the right door 6 in a trailing door position in contacting engagement with the stop 25. As the right door 6 moves over the right door closing path from the open position to the closed position (such as, by way of the air cylinder 15), the stop 25 is adapted to selectively stop the right door 6 at the trailing door position along the right door closing path and to prevent the right door 6 from moving to the closed position.

In FIG. 4, the right door 6 has come into contact with the first rotating wheel 31, engaging the stop 25. When the sequential door-closing system 24 is positioned as shown, the locking interface 43 between the cam 37 and the trigger 26 prevents the stop 25 from rotating out of the closing path of the right door 6. In this manner, the stop 25 selectively prevents the right door 6 from moving further toward the closed position. The actuator 14 can continue to retract to move the left door 5 in the closing direction 81 toward the closed position.

The trigger 26, when in the lock position, is adapted to contact the left door 5 at a leading door position along the left door closing path. The leading door position is closer to the closed position of the left door 5 than the trailing door position is to the closed position of the right door 6.

Figure 5:
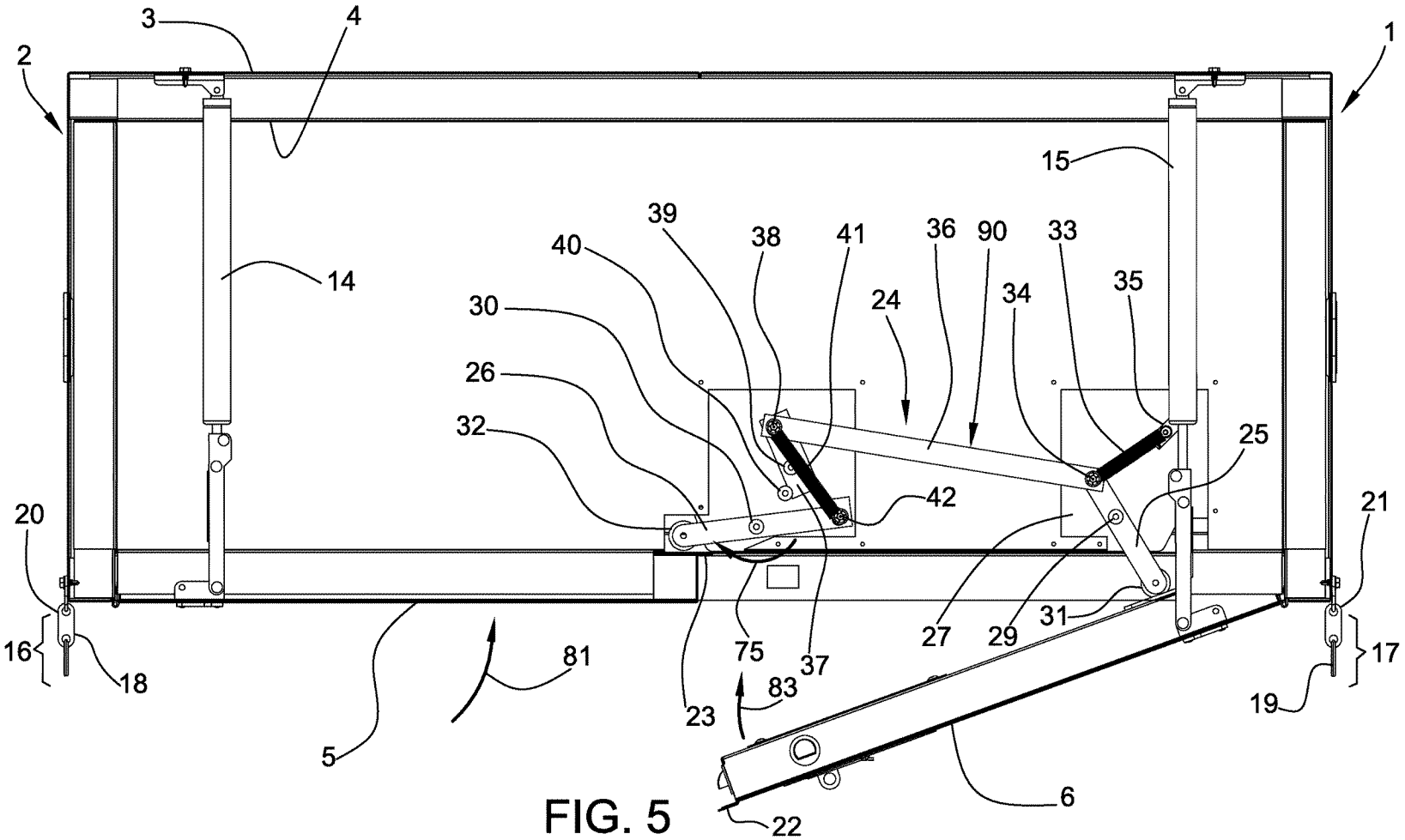
FIG. 5 is a top plan view of the safety cabinet as in FIG. 3, illustrating the left door in the closed position and the right door remaining in the partially-open position.

Referring to FIG. 5, as the left door 5 moves over the left door closing path from the open position to the closed position (such as, by way of the air cylinder 14), the left door 5 contacts the trigger 26 at the leading door position such that continued movement of the left door 5 to the closed position causes the trigger 26 to rotate in a release direction 75 away from the locked position to the retracted position to thereby disengage from the connecting assembly 90 and rotate the stop 25 away from the stop position to the retracted position. The right door 6 is then allowed to move to the closed position after the left door 5 is in the closed position.

As shown in FIG. 5, while the right door 6 is temporarily stopped, the left door 5 continues to move in the closing direction 81 to the closed position until it contacts the rotating wheel 32 at the distal end of the trigger 26. After initial contact with the rotating wheel 32 of the trigger 26, the continued movement of the left door 5 in the closing direction 81 causes the trigger 26 to rotate about the trigger pivot pin 30 in a release direction 75. Rotation of the trigger 26 about the trigger pivot pin 30 in the release direction 75 causes the trigger 26 to move out of its locked position with the cam 37. After initially contacting the distal end 32 of the trigger 26, the left door 5 continues to move in the closing direction 81 until it contacts the top jamb 7 and bottom jamb 8 of safety cabinet 1, at which point the left door 5 has completed its closing motion and is in the fully-closed position. With the cam 37 and the trigger 2 disengaged from each other, the second air cylinder 15 can operate to move the right door 6 in the closing direction 83 toward the closed position.

Figure 6:
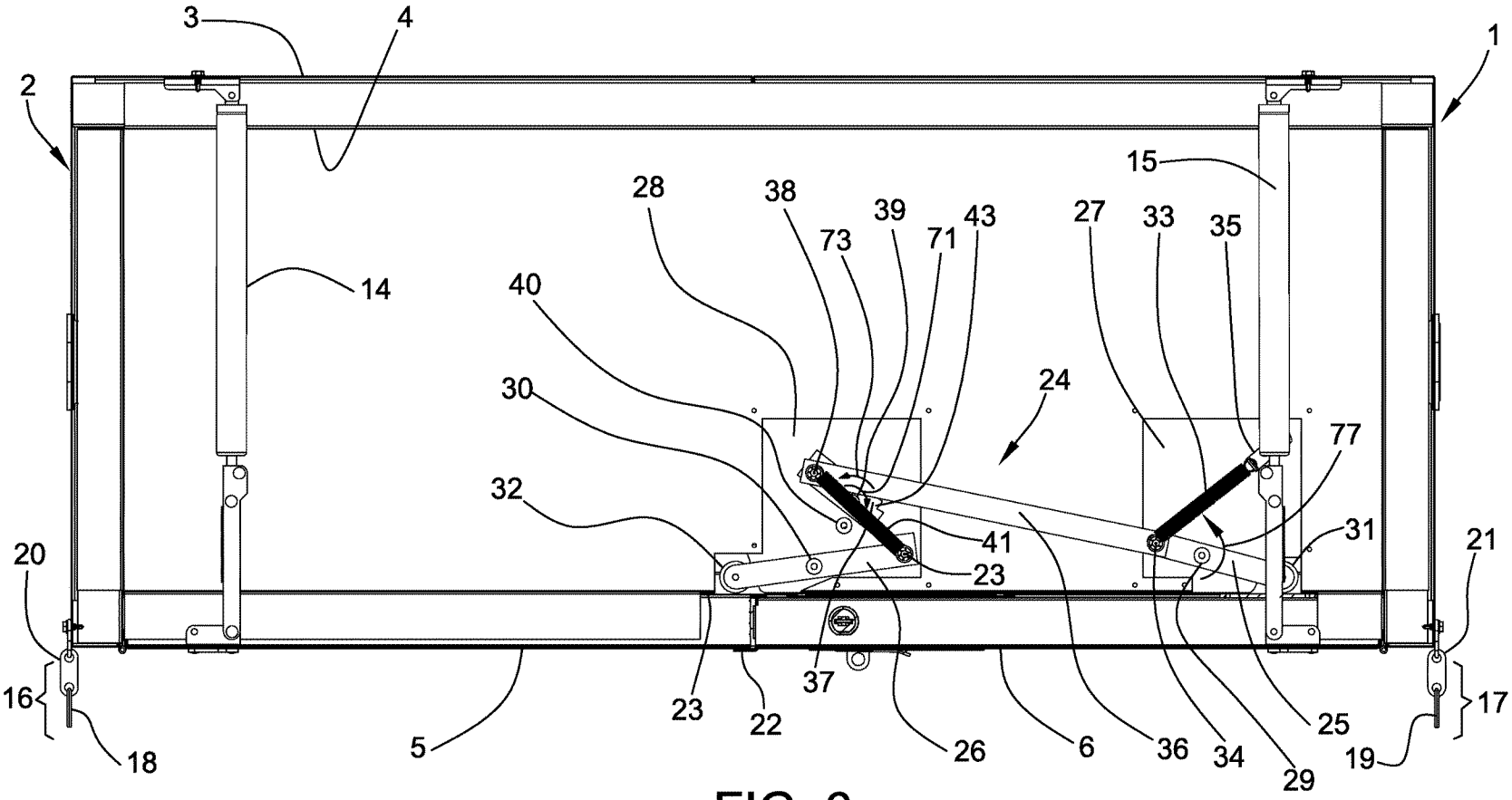
FIG. 6 is a top plan view of the safety cabinet as in FIG. 3, illustrating the left and the right doors in the closed position.

FIG. 6 shows the right door 6 in a closed position. After the cam 37 is disengaged from the trigger 26, the air cylinder 15 associated with the right door 6 can continue to act to move the right door 6 to the closed position. The stop 25 can rotate about the stop pivot pin 29 in a closing direction 77 to allow the right door 6 to move to the closed position. The movement of the stop 25 is transferred to the cam 37 via the connecting member 36 so that the cam 37 rotates about the cam pivot pin 39 in a retracting direction 73 which is in opposing relationship to the extending direction 71. The stop spring 33 and the trigger spring 41 are stretched such that they contain spring force sufficient to bias the sequential door-closing system 24 toward the ready position. When the left and right doors 5, 6 are moved from the closed position, as shown in FIG. 6, to an open position, such as is shown in FIG. 3, the sequential door-closing system 24 moves from the position shown in FIG. 6 to that shown in FIG. 3 through the urging of the springs 33, 41.

The safety cabinet 1 can be similar in construction and functionality in other respects to the safety cabinets shown and described in U.S. Pat. No. 6,729,701, which is incorporated in its entirety herein by this reference. In other embodiments, the safety cabinet 1 can be similar in construction and functionality in other respects to the safety cabinets shown and described in U.S. Patent Application Publication No. US2008/0106174, which is incorporated in its entirety herein by this reference.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the present disclosure (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the present disclosure and does not pose a limitation on the scope of the present disclosure unless otherwise claimed. No language in the specification should be construed as indicating any non-claimed element as essential to the practice of the present disclosure.

Preferred embodiments of this present disclosure are described herein, including the best mode known to the inventors for carrying out the present disclosure. Of course, variations of those preferred embodiments will become apparent to those of ordinary skill in the art upon reading the foregoing description. The inventors expect skilled artisans to employ such variations as appropriate, and the inventors intend for the present disclosure to be practiced otherwise than as specifically described herein. Accordingly, this present disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A safety cabinet comprising:

an enclosure defining an opening;

a first door and a second door, each door being rotatably mounted to the enclosure and moveable over a range of travel between an open position and a closed position, the first and second doors adapted to cover the opening of the enclosure when in the closed position;

a sequential door-closing system adapted to sequentially close the first and second doors such that when the first and second doors move in respective first and second door closing paths from the open position to the closed position, the first door is in the closed position before the second door, the sequential door-closing system including a stop member, a connecting assembly, a trigger member, and a trigger biasing mechanism, wherein:

the stop member is rotatably mounted to the enclosure and moveable over a range of travel between a stop position, in which at least a portion of the stop member is disposed in the second door closing path of the second door, and a retracted position, in which the stop member is displaced from the second door closing path, the stop member being biased to the stop position, the connecting assembly is in interconnecting relationship with the stop member and the trigger member, the connecting assembly adapted to contactingly engage the trigger member at a locking interface to selectively retain the stop member in the stop position, the trigger member is rotatably mounted to the enclosure and moveable over a range of travel between a locked position, in which the trigger member and the connecting assembly are in interlocking relationship at the locking interface to prevent rotational movement of the stop member from the stop position and in which at least a portion of the trigger member is disposed in the first door closing path of the first door, and a retracted position, in which the trigger member is displaced from the first door closing path, and the trigger member being biased to the locked position, wherein the connecting assembly includes a cam with a first end and a second end, the cam pivotally mounted to the enclosure, the first end of the cam being engaged with the trigger member when the trigger member is in the locked position so as to prevent the cam from rotating, and a crosslink with a first end and a second end, the first end of the crosslink being pivotally connected to the stop member, and the second end of the crosslink being pivotally connected to the second end of the cam, wherein the first end of the cam and the trigger member define the locking interface therebetween when the trigger member is in the locked position, the locking interface configured to prevent the cam from rotating in a retracting direction, and the trigger biasing mechanism is adapted to bias the trigger member to the locked position, the trigger biasing mechanism comprising a spring connected at one end to the trigger member and at the other end to both the second end of the cam and the second end of the crosslink; and wherein, as the second door moves over the second door closing path from the open position to the closed position, the stop member is adapted to selectively stop the second door at a trailing door position along the second door closing path and to prevent the second door from moving to the closed position;

wherein the trigger member, when in the locked position, is adapted to contact the first door at a leading door position along the first door closing path, the leading door position being closer to the closed position of the first door than the trailing door position is to the closed position of the second door; and wherein, as the first door moves over the first door closing path from the open position to the closed position, the first door contacts the trigger member at the leading door position such that continued movement of the first door to the closed position causes the trigger member to rotate in a release direction away from the locked position to the retracted position to thereby disengage the trigger member from the connecting assembly such that the trigger member is no longer in contacting relationship with the cam at the locking interface, thereby allowing the stop member to rotate away from the stop position to the retracted position to allow the second door to move to the closed position after the first door is in the closed position.

2. The safety cabinet of claim 1, wherein the stop member includes a distal end comprising a first rotating wheel, and the trigger member includes a distal end comprising a second rotating wheel, the first and second wheels configured to rotatingly engage the first and second doors, respectively, to permit relative movement therebetween when the first and second doors move from the leading door intermediate position to the closed position and the trailing door intermediate position to the closed position, respectively.

3. The safety cabinet of claim 1, wherein the first door has an inner sealing flange, and the second door has an outer sealing flange, the flanges configured so as to be in overlapping relationship with each other when the first and second doors are in the closed position.

4. The safety cabinet of claim 1, wherein the connecting assembly of the sequential-door closing system further includes a cam stop member adapted to limit rotation of the cam in an extending direction, the extending direction being in opposing relationship to the retracting direction.

5. The safety cabinet of claim 1, wherein the sequential-door closing system further includes a stop biasing mechanism adapted to bias the stop to the stop position.

6. The safety cabinet of claim 5, wherein the stop biasing mechanism comprises a spring attached at one end to the enclosure and at the other end to the stop member and the first end of the crosslink.

7. The safety cabinet of claim 1, further comprising:

first and second actuators adapted to urge the first and second doors, respectively, to the closed position.

8. The safety cabinet of claim 7, further comprising:

first and second door retention mechanisms adapted to selectively retain the first and second doors, respectively, in the open position.

9. The safety cabinet of claim 8, wherein the first and second door retention mechanisms each comprises a fusible link respectively connecting the first door and the enclosure and the second door and the enclosure, the fusible links being configured to fuse when the ambient temperature reaches a predetermined temperature, thereby allowing the first and second doors to respectively move to the closed position.

10. The safety cabinet of claim 1, further comprising:

first and second door retention mechanisms adapted to selectively retain the first and second doors, respectively, in the open position.

11. A sequential door-closing system configured to sequentially close first and second doors rotatably mounted to an enclosure, the first and second doors each movable over a range of travel between an open position and a closed position, the sequential door-closing system comprising a stop member, a connecting assembly, a trigger member, and a trigger biasing mechanism, wherein:

the stop member is adapted to be rotatably mounted to the enclosure and moveable over a range of travel between a stop position and a retracted position, the stop member being biased to the stop position;

the connecting assembly is in interconnecting relationship with the stop member and the trigger member, the connecting assembly adapted to contactingly engage the trigger member at a locking interface to selectively retain the stop member in the stop position; and the trigger member adapted to be rotatably mounted to the enclosure and moveable over a range of travel between a locked position, in which the trigger member and the connecting assembly are in interlocking relationship at the locking interface to prevent rotational movement of the stop member from the stop position, and a retracted position, and the trigger member being biased to the locked position via the trigger biasing mechanism;

wherein the connecting assembly includes a cam with a first end and a second end, the cam pivotally mounted to the enclosure, the first end of the cam being engaged with the trigger member when the trigger member is in the locked position so as to prevent the cam from rotating, and a crosslink with a first end and a second end, the first end of the crosslink being pivotally connected to the stop member, and the second end of the crosslink being pivotally connected to the second end of the cam;

wherein the first end of the cam and the trigger member define the locking interface therebetween when the trigger member is in the locked position, the locking interface configured to prevent the cam from rotating in a retracting direction;

wherein moving the trigger member from the locked position in a release direction toward the retracted position disengages the trigger member from the connecting assembly such that the trigger member is no longer in contacting relationship with the cam at the locking interface and such that the stop member is rotatable from the stop position to the retracted position; and wherein the trigger biasing mechanism comprising a spring connected at one end to the trigger member and at the other end to both the second end of the cam and the second end of the crosslink.

12. The sequential door-closing system of claim 11, wherein the stop member includes a distal end, and the trigger member includes a distal end, the distal end of the trigger in offset outward relationship to the distal end of the stop member when the trigger member is in the locked position and the stop member is in the stop position.

13. The sequential door-closing system of claim 11, wherein the stop member includes a distal end comprising a first rotating wheel, and the trigger member includes a distal end comprising a second rotating wheel.

14. The sequential door-closing system of claim 11, wherein the connecting assembly includes a cam stop member adapted to limit rotation of the cam in an extending direction, the extending direction being in opposing relationship to the retracting direction.

15. The sequential door-closing system of claim 11, further comprising:

a stop biasing mechanism, the stop biasing mechanism being adapted to bias the stop to the stop position.

16. The sequential door-closing system of claim 15, wherein the stop biasing mechanism comprises a spring attached at one end to the stop member and the first end of the crosslink.

* * * * *